US006110359A

United States Patent [19]

Davis et al.

[11] Patent Number: 6,110,359

[45] **Date of Patent: *Aug. 29, 2000**

[54] METHOD FOR EXTRACTING BITUMEN FROM TAR SANDS

[75] Inventors: R. Michael Davis, North Richland Hills; James M. Paul, DeSoto, both of Tex.

[73] Assignee: Mobil Oil Corporation, Fairfax, Va.

[ * ] Notice: This patent is subject to a terminal disclaimer.

[21] Appl. No.: 08/647,850

[22] Filed: May 15, 1996

Related U.S. Application Data

[63] Continuation-in-part of application No. 08/547,081, Oct. 17, 1995, abandoned.

[51] Int. Cl.[7] ..... C10G 1/00

[52] U.S. Cl. ..... 208/390; 208/400; 208/425

[58] Field of Search ..... 208/390, 400, 208/391

[56] References Cited

U.S. PATENT DOCUMENTS

| | | | |
|---|---|---|---|
| 2,941,908 | 6/1960 | Logan | 134/1 |
| 2,973,312 | 2/1961 | Logan | 208/11 |
| 3,017,342 | 1/1962 | Bulat et al. | 208/11 |
| 4,054,505 | 10/1977 | Hart, Jr. et al. | 208/11 |
| 4,054,506 | 10/1977 | Hart, Jr. et al. | 208/11 |
| 4,110,194 | 8/1978 | Peterson et al. | 208/112 LE |
| 4,120,775 | 10/1978 | Murry et al. | 208/112 LE |
| 4,151,067 | 4/1979 | Grow | 208/112 LE |
| 4,304,656 | 12/1981 | Lee | 208/11 |
| 4,376,034 | 3/1983 | Wall | 208/11 |
| 4,443,322 | 4/1984 | Jubenville | 208/11 |
| 4,765,885 | 8/1988 | Sadeghi et al. | 208/391 |
| 4,891,131 | 1/1990 | Sadeghi et al. | 208/390 |
| 5,017,281 | 5/1991 | Sadeghi et al. | 208/390 |

*Primary Examiner*—Helane Myers
*Attorney, Agent, or Firm*—Malcolm D. Keen

[57] ABSTRACT

A method for extracting bitumen from crushed mined tar sands comprising contacting the mined tar sands with a solvent in the presence of sonic energy in the frequency range of 0.5 to 2.0 kHz. Specifically, a solvent is first mixed with crushed mined tar sands and the mixture is then formed into a slurry of tar sand suspended in the solvent. Thereafter the tar sand slurry is injected into the top of a vertically disposed, substantially rectangular shaped, hollow acoustic chamber of uniform cross-section. Fresh solvent is injected into the bottom of the acoustic chamber and flows upwardly through the cell. The fresh solvent is injected into the bottom of the acoustic chamber at a rate low enough whereby the tar sand particles in the slurry fall by gravity through the upwardly flowing solvent. The tar sand particles and solvent in the acoustic chamber are subjected to acoustic energy in the frequency range of 0.5 to 2.0 kHz whereby the bitumen is separated from the tar sand and dissolved by the upwardly flowing solvent without cavitation of the solvent. The bitumen dissolved in the solvent is recovered from the top of the acoustic chamber and transferred by pipeline to an off-site refinery. The bitumen-extracted sand particles recovered from the bottom of the acoustic chamber may be recycled to the top of the acoustic chamber to recover additional bitumen after injection of the slurry has been discontinued.

13 Claims, 2 Drawing Sheets

METHOD FOR EXTRACTING BITUMEN FROM TAR SANDS

This is a continuation-in-part application of Ser. No. 08/547,081, filed Oct. 17, 1995, now abandoned.

FIELD OF THE INVENTION

This invention relates to a method for extracting bitumen from mined tar sands employing a solvent and sonic acoustic energy in the low frequency range of 0.5 to 2.0 kHz.

BACKGROUND OF THE INVENTION

This invention is concerned with the extraction of bitumen from tar sands.

Approximately 30 billion barrels of tar sand bitumen in Athabasca (out of 625 billion barrels in Alberta) and part of 26 billion barrels in Utah are accessible to mining. Tar sands are essentially silicious materials such as sands, sandstones or diatomaceous earth deposits impregnated with about 5 to 20% by weight of a dense, viscous, low gravity bitumen. The mined sands are now commercially processed for bitumen recovery by the "Clark Hot Water" method. In the Athabasca region, it has been estimated that, at most, two additional plants of the 125,000 bpd size can make use of this recovery technique; this restriction stems from severe environmental constraints such as high water and energy consumption and tailings disposal. Two alternate bitumen recovery methods are being pursued: thermal treatment (e.g., retorting) and extraction with solvents. Both have high energy requirements; the first—poor sensible heat recovery and the burning of part of the resources, and the second—solvent-bitumen separation and solvent loss through incomplete steam stripping. Shortcomings of these approaches are minimized by the present process. Finally, Utah tar sand and minable resources in the Athabasca region are both recoverable by this method.

Various types of thermal (pyrolysis) processes and solvent extraction processes have heretofore been used to extract synthetic crude from tar sands. Some of the thermal processes presently known involve the use of a variety of horizontal or vertical retort vessels or kilns for the retort. In particular the Lurgi-Rhurgas process uses a mixing screw-type retort and the Tacuik process uses a rotary kiln-type retort. Some of the solvent extraction processes presently known are the Western Tar Sand processes described in the U.S. Pat. Nos. 4,054,505 and 4,054,506 which includes the use of ultrasonic energy, the CAG (Charles-Adams-Garbett) process using a water-base extraction, and the Randall process using hot water. Past practices have generally involved the use of either a thermal process or a solvent extraction process.

Applicant's copending application, Mobil Docket No. 7757, entitled "Method for Extracting Oil From Oil-Contaminated Soil" and commonly assigned, discloses a method similar to the present invention for extracting oil from oil-contaminated soil using a solvent and sonic energy in the low frequency range of 0.5 to 2.0 kHz.

U.S. Pat. No. 2,973,312 discloses a method of removing oil from sand, clay and the like, including employing ultrasonic vibration and a solvent.

U.S. Pat. Nos. 4,054,505 and 4,054,506 disclose a method of removing bitumen from tar sand using ultrasonic energy.

U.S. Pat. No. 4,151,067 discloses a method for removing oil from shale by applying ultrasonic energy to a slurry of shale and water.

U.S. Pat. No. 4,304,656 discloses a method for extracting oil from shale by employing ultrasonic energy.

U.S. Pat. No. 4,376,034 discloses a method for recovering oil from shale employing ultrasonic energy at frequencies between 300 MHz and 3,000 MHz.

U.S. Pat. No. 4,443,322 discloses a method for separating hydrocarbons from earth particles and sand employing ultrasonic energy in the frequency range of 18 to 27 kHz.

In U.S. Pat. No. 4,495,057 there is disclosed a combination thermal and solvent extraction process wherein the thermal and solvent extraction operations are arranged in parallel which includes the use of ultrasonic energy.

U.S. Pat. Nos. 4,765,885 and 5,017,281 disclose methods for recovering oil from tar sands employing ultrasonic energy in the frequency range of 5 to 100 kHz and 25 to 40 kHz respectively.

U.S. Pat. No. 4,891,131 discloses a method for recovering oil from tar sands employing ultrasonic energy in the frequency range of 5 to 100 kHz.

In contrast to the prior art, in the present invention mined tar sands containing bitumen are mixed with a solvent to form a tar sand/solvent slurry, the upwardly flowing solvent e slurry is fed into the top of a vertically disposed acoustic chamber and fresh solvent is injected into the bottom of the acoustic chamber and flows upwardly at a controlled rate whereby the particles of tar sand fall by gravity through the solvent and are subjected to sonic energy in the low frequency range of 0.5 to 2.0 kHz whereby the bitumen is removed from the tar sand and dissolved by the upwardly flowing solvent without cavitation of the solvent.

SUMMARY

A method of recovering of bitumen from mined tar sand comprising:

(a) mixing mined sands containing bitumen in a solvent to form a slurry of tar sand particles suspended in the solvent;

(b) injecting the slurry into the upper end of a vertically disposed, hollow chamber of uniform cross-section;

(c) substantially simultaneously with step (b) injecting a fresh solvent into the lower end of said hollow chamber of uniform cross-section in a direction opposite the flow of the slurry;

(d) controlling the flow rate of the fresh solvent so that the mined sand particles fall by gravity through the fresh solvent;

(e) applying sonic energy in the frequency range of 0.5 to 2.0 kHz to the slurry and solvent without cavitation of the solvent in the hollow chamber whereby the bitumen on the sand particles is extracted and dissolved by the solvent;

(f) recovering the tar sand particles from the bottom of the hollow chamber;

(g) recovering the solvent containing the bitumen from the top of the hollow chamber; and (h) recovering the bitumen from the solvent.

An object of this invention is to more effectively remove bitumen from tar sands by forming a slurry of tar sands in a solvent, injecting the slurry into the top of an acoustic chamber, injecting fresh solvent into the bottom of the acoustic chamber that flows upwardly at a controlled rate whereby the particles of tar sand fall by gravity through the solvent and subjecting the particles of tar sand to sonic energy in the frequency range of 0.5 to 2.0 kHz whereby the bitumen is removed from the tar sand and dissolved by the upwardly flowing solvent without cavitation of the solvent. It is an advantage of the present invention that the use of sonic energy in the low frequency range of 0.5 to 2.0 kHz and the shape of the acoustic chamber combined with the counter-current flow of the tar sand particles and solvent enable the bitumen to be more effectively removed from the tar sands.

DESCRIPTION OF THE PREFERRED EMBODIMENT

According to the present invention, mined tar sands containing bitumen are suspended in a solvent to form a slurry of tar sand particles in the solvent and subjecting the tar sand particles to sonic acoustic energy in the low frequency range of 0.5 to 2.0 kHz in a vertically disposed, rectangular shaped acoustic chamber of uniform cross-section.

Figure 1:
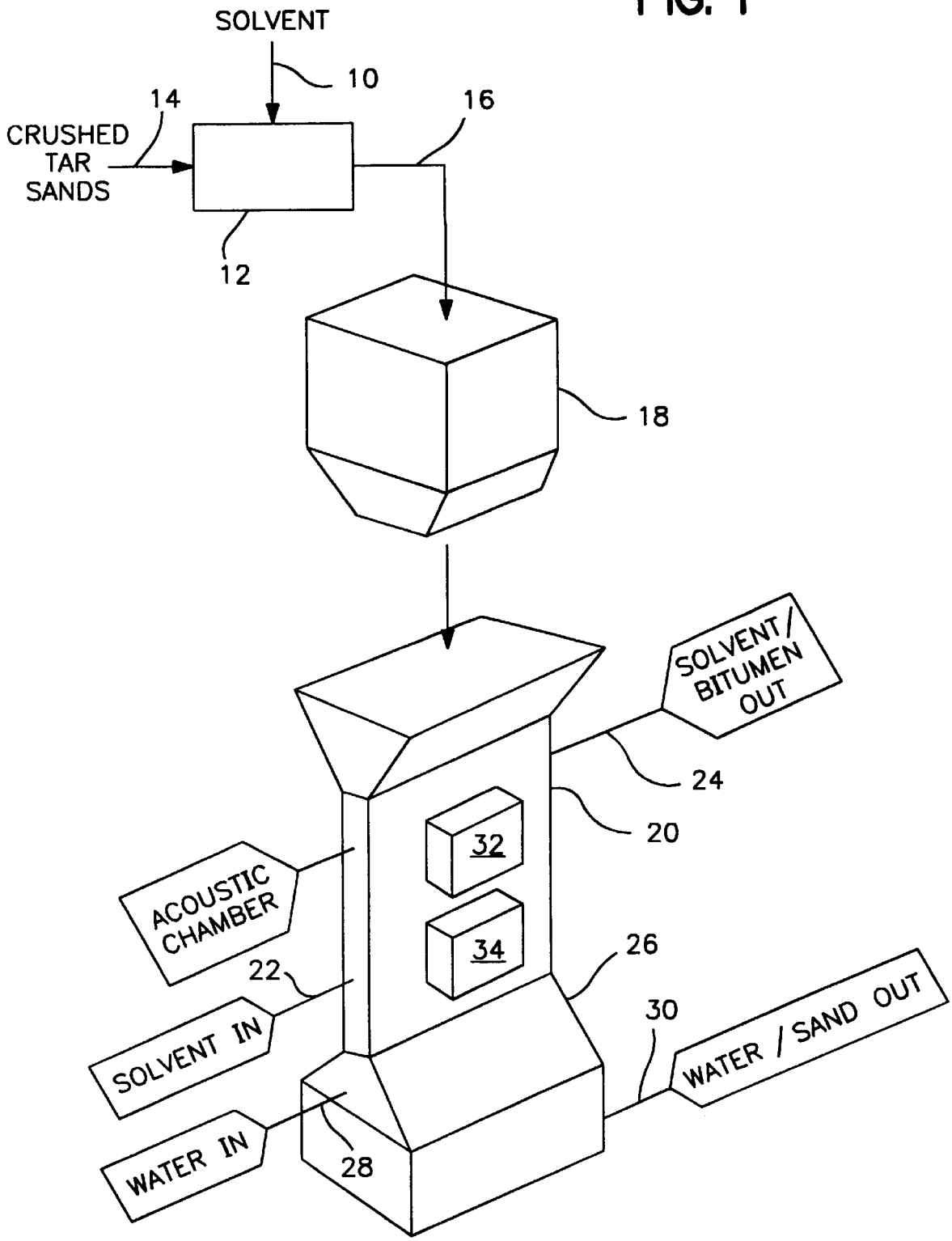
FIG. 1 is a self-explanatory diagrammatic representation of an example of a method for recovering bitumen from tar sands according to the present invention.

Referring to FIG. 1, a solvent which may be a light crude oil or mixture of light crude oils obtained from a nearby oil field or reservoir is fed through line 10 into tank 12 where it is mixed with crushed mined tar sand received via line 14. The ratio of mined tar sands to solvent is dependent upon the tar sand properties. Usually, the ratio of mined tar sands to solvent is about 0.3 to 15% by volume, preferably about 8 to 10% by volume. The solvent and bitumen in the tar sand are mutually miscible. The mined tar sand is crushed, usually to a particular particle size no greater than ¼ inch, to provide a tar sand/solvent slurry that can be introduced directly into the acoustic chamber subjected to sonic energy. It is preferred that the tar sands be crushed to a particulate size comparable to sand, a granular size which is inherent in many tar sands. The mixture of tar sands and solvent is fed through line 16 to a slurry mixer 18 where the tar sands and solvent are thoroughly mixed to form a slurry of tar sands suspended in the solvent. During the mixing of tar sands and solvent, a portion of the bitumen in the tar sands is dissolved in the solvent and a portion of the solvent is dissolved in the bitumen remaining in the tar sands. The tar sand slurry is then fed into the top of a vertically disposed, substantially rectangular shaped, acoustic chamber 20 of uniform cross-section. Fresh solvent is introduced into the bottom of the acoustic chamber 20 via line 22 that flows upwardly through the acoustic chamber. The fresh solvent is injected into the bottom of the acoustic chamber 20 at a controlled rate low enough so that the tar sand granules in the slurry fall by gravity through the upwardly flowing solvent. The tar sand particles and solvent are subjected to acoustic energy in the low frequency range of 0.5 to 2.0 kHz, preferably 1.25 kHz, whereby the bitumen is separated from the tar sand granules and dissolved by the upwardly flowing solvent without cavitation of the solvent. The upwardly flowing solvent-bitumen mixture exits from the top of the acoustic chamber 20 via line 24 and is fed into a pipeline to an off-site refinery.

The bitumen-extracted sand granules fall downwardly by gravity flow through the acoustic chamber 20 into a settling tank 26 containing water introduced via line 28. The mixture of water and bitumen-extracted sand is removed from tank 26 via line 30. The bitumen-extracted sand may be dumped after removal from tank 26 or recycled to the acoustic chamber 20.

In another embodiment of the invention, bitumen-extracted sand particles recovered from the bottom of the acoustic chamber are recycled to the top of the acoustic chamber. During recycling injection of the tar sand slurry is discontinued. The recycled bitumen-extracted sand particles fall through the upwardly flowing solvent and are subjected to the sonic energy in the frequency range of 0.54 to 2.0 kHz so that additional bitumen is displaced and dissolved by the solvent. The bitumen is then recovered from the solvent. The bitumen-extracted sand particles may be recycled for a plurality of cycles until the amount of bitumen recovered is unfavorable or the sand particles are substantially bitumen-free.

Still in another embodiment of the invention, the recovered bitumen-extracted sand particles from the bottom of the acoustic chamber may be passed into a second acoustic chamber operated under the same conditions as the first acoustic chamber where additional bitumen is recovered. The oil extracted sand is fed directly into the second acoustic chamber without first forming a slurry. The recycled bitumen extracted sand particles fall by gravity through the upwardly flowing solvent while being subjected to sonic energy in the frequency range of 0.5 to 2.0 kHz without cavitation of the solvent so that unextracted bitumen on the tar sand particles is displaced and dissolved by the solvent. The solvent is recovered from the top of the second acoustic chamber and the dissolved bitumen is recovered from the solvent.

The sonic energy is generated in the acoustic chamber 20 by transducers 32 and 34 attached to the mid-section of the outer surface of one of the widest sides of the acoustic chamber. The transducers 32 and 34 are magnetostrictive transducers manufactured under the trademark "T"-Motor® by Sonic Research Corporation, Moline, Ill. Suitable transducers for use in the present invention are disclosed in U.S. Pat. No. 4,907,209 which issued to Sewall et al on Mar. 6, 1990. This patent is incorporated herein by reference. The transducers are powered by a standard frequency generator and a power amplifier. Depending on the resonant frequency of the sonic transducers, the required frequency may range from 0.5 to 2.0 kHz. Operating at the resonant frequency of the sonic source is desirable because maximum amplitude, or power, is maintained at this frequency. Typically, this frequency is from 0.5 to 2.0 kHz for the desired equipment, preferably 1.25 kHz.

The acoustic chamber 16 consists of a vertically disposed, substantially rectangular shaped, hollow chamber of uniform cross section. Preferably, the acoustic chamber 16 is a vertically disposed, rectangular shaped, hollow chamber of uniform cross-section having a first pair of substantially flat parallel sides and a second pair of flat parallel sides wherein the first pair of flat parallel sides is substantially greater in width than the second pair of flat parallel sides. The transducers used to generate the sonic energy are preferably attached to the mid-section of the outer surface of one of the widest sides of the acoustic chamber. The shape of the acoustic chamber and location of the transducers enable the sonic energy at the low frequencies to be transmitted at the maximum amplitude, or power, without cavitation of the solvent that would possibly interfere with the settling of tar sand granules by gravity through the upwardly flowing solvent. In addition, the use of sonic energy in the low frequency range without cavitation of the solvent more effectively penetrates the bitumen/sand grain bond and results in the detachment of the bitumen from the sand grains which is then dissolved by the upwardly flowing solvent. The acoustic chamber 16 has a volume proportionate to the size and power output of the acoustic transducers.

The solvent may be any liquid hydrocarbon which is miscible with the bitumen in the tar sand. Suitable solvents include naphtha, light crude oil, condensate, raw gasoline, kerosene, hexane and toluene. The light crude oil or mixture of light crude oils or condensate may be obtained from a nearby oil field or reservoir. In the case of the Athabasca tar sands in Alberta, Canada, for example, the solvent may be the side stream of condensate obtained from the Harmattan gas plant or the light crude oil obtained from the Pembina Field or the Carson Creek reservoir (Beaver Hill Lake Field, N.W. of Edmonton, as even lighter crude oil).

Figure 2:
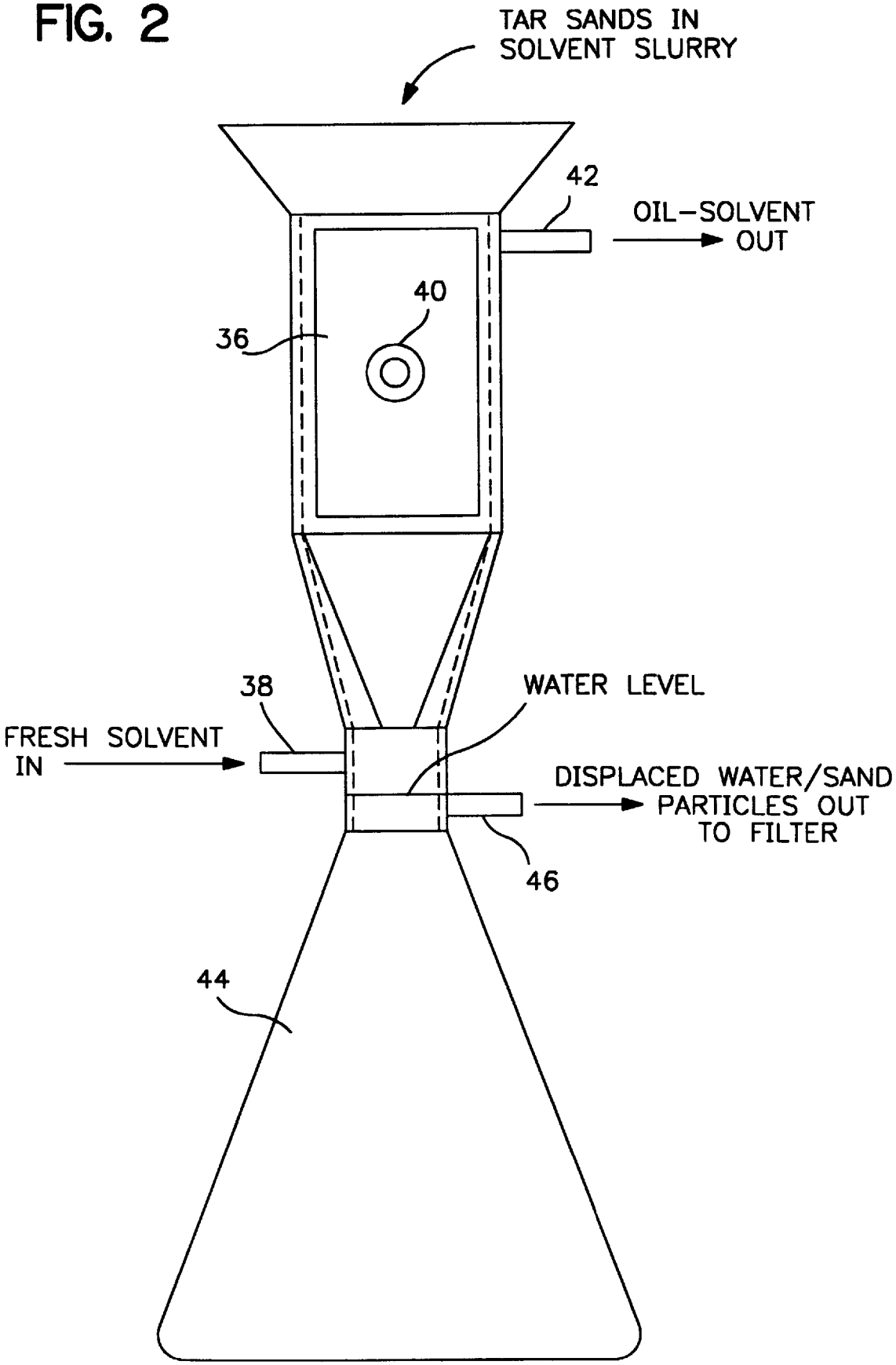
FIG. 2 is a schematic diagram illustrating the laboratory apparatus used according to the present invention.

FIG. 2 illustrates the laboratory solvent extracter apparatus. A 500 gram sample of tar sands containing 10 to 12 wt. % bitumen was mixed with 250 ml of solvent toluene or kerosene for 5 minutes to form a slurry. Referring to FIG. 2, the slurry of tar sand suspended in the solvent was introduced into the top of acoustic chamber 36. Fresh solvent was introduced into the bottom of the acoustic chamber 36 through line 38 and flows upwardly through the acoustic chamber at a controlled rate low enough whereby the tar sand particles in the slurry fall by gravity through the upwardly flowing fresh solvent. The tar sand particles and solvent in the acoustic chamber 36 are subjected to sonic energy at a frequency of 1.25 kHz and a power level of 6.5 without cavitation of the solvent. The sonic energy is generated by transducer 40 attached to the outer surface of the acoustic chamber 36. The acoustic chamber 36 consists of a vertically diagonal, substantially rectangular shaped, hollow chamber of uniform cross section. The low frequency sonic energy removes the bitumen from the tar sand particles which is dissolved by the upwardly flowing solvent without cavitation of the solvent. The solvent-plus-bitumen exits from the top of the acoustic chamber 36 through line 42. The bitumen extracted sand particles settle by gravity into flask 44 containing water to form a slurry of oil extracted sand particles suspended in water. The water-sand slurry was removed from flask 44 via line 46 and filtered to remove the water. The residual bitumen from the sand was collected in a Soxhlet extractor using toluene. Alternatively, the sand sample was air-dried overnight at about ambient temperature before Soxhlet extraction to remove any residual solvent. Test runs were also conducted without using sonic energy and feeding the tar sands directly into the acoustic chamber without first forming a slurry.

The operating conditions and results of solvent extractions employing the apparatus shown in FIG. 2 are shown in Tables 1 to 4.

Table 1 presents the results of test runs 1A, 1B, 2 and 3 using a slurry and a toluene solvent with sonic energy at a frequency of 1.0 and 1.25 kHz and without sonic energy.

TABLE 1

(POWERSONICS Enhanced)
Counter-Current Solvent Extraction of Tar Sand
Oil Content of Tar Sand = 10–12 wt %

| Test # | weight, tar sand, g | Solvent mi/min | Recovered Oil, % | Comments |
|---|---|---|---|---|
| 1A | 500 | toluene, 250 | 92.7 | slurry*, sonics (1.0 kHz); 1st pass |
| 1B | 500 | toluene, 250 | 93.9 | 2nd pass |
| 2 | 500 | toluene, 250 | 98.2 | slurry, sonics (1.25 kHa); 1st pass |
| 3 | 500 | toluene, 250 | 97.5 | slurry, no sonics |

*slurry; 500 g tar sand/250 ml solvent; mixed 5 minutes

In the above results, Run 2 shows the amount of oil recovered using a slurry and a toluene solvent with sonic energy at a frequency of 1.25 kHz and Run 3 shows the results under the same conditions without sonic energy. These results show that the amount of oil recovered using sonic energy is greater than without sonic energy. These results also show that toluene is a very effective solvent, however, toluene would be too expensive to use commercially. Run 1A was the same as Run 2 except that the frequency for Run 1A was 1.0 kHz and the frequency for Run 2 was 1.25 kHz. A frequency of 1.25 kHz was the resonant frequency of the transducer which is the preferred frequency. These results show that changing the frequency from 1.0 kHz to the resonant frequency 1.25 kHz increases oil recovery from 92.7 to 98.2 wt. %. In Run 1B the oil-extracted sand particles recovered from Run 1A were recycled to the acoustic chamber without forming a slurry and subjected to the same conditions as Run 1A using a frequency of 1.0 kHz. Run 1B demonstrates that recycling the oil-extracted sand particles to the acoustic chamber increases the amount of oil recovered from 92.7 to 93.9 wt. %.

Table 2 presents the results of test runs 4 and 5 using a slurry and a kerosene solvent with sonic energy at a frequency of 1.25 kHz and without sonic energy. frequency of 1.0 and 1.25 kHz and without sonic energy.

TABLE 2

(POWERSONICS Enhanced)
Counter-Current Solvent Extraction of Tar Sand
Oil Content of Tar Sand = 10–12 wt %

| Test # | weight, tar sand, g | Solvent mi/min | Recovered Oil, % | Comments |
|---|---|---|---|---|
| 4 | 500 | kerosene, 250 | 60.1 | slurry, sonics (1.25 kHz) |
| 5 | 500 | kerosene, 250 | 50 | slurry, no sonics |

*slurry; 500 g tar sand/250 ml solvent; mixed 5 minutes

The results in Table 2 show that the use of sonic energy increases oil recovery from 50 to 60.1 wt. %, a 20% increase in oil recovery. Based upon the current production of crude oil from tar sands by Syncrude, the largest tar sand mining and upgrading complex in the world, a 20% increase in production would amount to an additional 1.5 million barrels of crude oil per year. The results in Table 2 also show that kerosene is not as effective a solvent as toluene, however, as stated above, toluene would be too expensive to use commercially.

Table 3 presents the results of test Runs 6 and 7 using a kerosene solvent with sonic energy at a frequency of 1.25 kHz and without sonic energy but without first forming a slurry.

TABLE 3

(POWERSONICS Enhanced)
Counter-Current Solvent Extraction of Tar Sand
Oil Content of Tar Sand = 10–12 wt %

| Test # | weight, tar sand, g | Solvent mi/min | Recovered Oil, % | Comments |
|---|---|---|---|---|
| 6 | 500 | kerosene, 250 | 36.7 | no slurry, sonics (1.25 kHz) |
| 7 | 500 | kerosene, 250 | 32.9 | no slurry, no sonics |

Run 6 shows the amount of oil recovered using a kerosene solvent with sonic energy at a frequency of 1.25 kHz but without first forming a slurry. Run 7 shows the results under the same conditions without sonic energy. These results show that without forming a slurry, the amount of oil recovered is less than the amount of oil recovered by first forming a slurry (as shown in Table 2), however, the amount of oil recovered using sonic energy was greater than without sonic energy.

Table 4 below presents the results of test Run 8 using a slurry and a kerosene solvent with sonic energy at a frequency of 1.25 kHz. After the 250 ml of slurry was passed through the acoustic chamber, the oil-extracted sand particles were recovered and recycled through the acoustic chamber for a second time. slurry.

TABLE 4

(POWERSONICS Enhanced)
Counter-Current Solvent Extraction of Tar Sand
Oil Content of Tar Sand = 10–12 wt %

| Test # | weight, tar sand, g | Solvent mi/min | Recovered Oil, % | Comments |
|---|---|---|---|---|
| 8 | 500 | kerosene, 250 | 88.2 | slurry*, sonics (1.25 kHz), two passes |

*slurry, 500 g tar sand/250 ml solvent; mixed 5 minutes

The results in Table 4 above show that if the oil-extracted tar sands are recovered from the bottom of the acoustic chamber and recycled to the acoustic chamber after the 250 ml of slurry has been treated, the amount of oil recovered was 88.2%. Compared to Run 4 above using kerosene and the same conditions with only one pass through the acoustic chamber, recycling the oil-extracted sand particles increased oil recovery from 60.1 to 88.2%. The recovered oil-extracted sand particles may be repeatedly recycled until the amount of oil recovered is unfavorable.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A method of recovering bitumen from mined tar sand particles that comprises the steps of:

(a) mixing the mined tar sand particles containing bitumen with a solvent to form a slurry of tar sand particles suspended in the solvent;

(b) injecting the tar sand slurry into the upper end of a vertically disposed, hollow chamber of uniform cross-section and substantially simultaneously injecting fresh solvent into the bottom of the hollow chamber and flowing the solvent upwardly through the hollow chamber at a controlled rate;

(c) subjecting the tar sand particles and solvent in the hollow chamber to sonic energy in the frequency range of about 0.5 to 2.0 kHz without cavitation of the solvent in said hollow chamber whereby the bitumen on the sand particles is displaced and dissolved by the solvent;

(d) recovering the sand particles from the bottom of the hollow chamber;

(e) recovering the solvent containing bitumen from the tope of the hollow chamber; and (f) recovering the bitumen from the solvent.

2. A method according to claim 1 wherein the solvent is selected from the group consisting of naphtha, light crude oil, condensate, raw gasoline, kerosene and toluene or mixtures thereof.

3. A method according to claim 1 wherein the frequency in step (e) is 1.25 kHz.

4. A method according to claim 1 wherein in step (a) the ratio of mined tar sands is about 0.3 to 15% by volume.

5. A method according to claim 1 wherein the mined tar sands are crushed to a particle size no greater than ¼ inch before they are mixed with the solvent in step (a).

6. A method according to claim 1 wherein injection of the slurry is discontinued, the recovered sand particles from step (d) are recycled to the upper end of the hollow chamber and steps (b) to (f) are repeated except for injection of the tar sand slurry.

7. A method according to claim 1 wherein the recovered sand particles from step (d) are passed into the upper end of a second vertically disposed, hollow chamber of uniform cross-section and steps (b) to (f) are repeated except for injection of the tar sand slurry.

8. A method of recovering bitumen from mined tar sand particles that comprises the steps of:

(a) injecting the mined tar sand particles containing bitumen into the upper end of a vertically disposed, hollow chamber of uniform cross-section and substantially simultaneously injecting solvent into the bottom of the hollow chamber that flows upwardly through the hollow chamber so that the tar sand particles fall by gravity through the upwardly flowing solvent;

(b) subjecting the tar sand particles and solvent in the hollow chamber to sonic energy in the frequency range of about 0.5 to 2.0 kHz without cavitation of the solvent in the hollow chamber whereby the bitumen on the sand particles is displaced and dissolved by the solvent;

(c) recovering the sand particles from the bottom of said hollow chamber;

(d) recovering the solvent containing bitumen from the top of the hollow chamber; and (e) recovering the bitumen from the solvent.

9. A method according to claim 8 wherein the solvent is selected from the group consisting of naphtha, light crude oil, condensate, raw gasoline, kerosene and toluene or mixtures thereof.

10. A method of claim 8 wherein the frequency in step (d) is 1.25 kHz.

11. A method of claim 8 wherein the mined tar sands are crushed to a particle size no greater than ¼ inch before they are mixed with the solvent in step (a).

12. A method according to claim 8 wherein injection of tar sand particles is discontinued, the recovered sand particles from step (c) are recycled to the upper end of the hollow chamber and steps (a) to (e) are repeated except for injection of the mined tar sand particles.

13. A method according to claim 8 wherein the recovered sand particles from step (c) are passed into the upper end of a second vertically disposed, hollow chamber of uniform cross-section and steps (b) to (e) are repeated except for injection of the mined tar sand particles.

* * * * *